US007387192B2

(12) United States Patent
Cloux et al.

(10) Patent No.: US 7,387,192 B2
(45) Date of Patent: Jun. 17, 2008

(54) COUNTERWEIGHT FOR AN ELEVATOR, BALLAST WEIGHTS FOR THIS COUNTERWEIGHT AND ELEVATOR EQUIPPED THEREWITH

(75) Inventors: Jean-Noël Cloux, Nogent sur Vernisson (FR); Thomas Coquerelle, Douai (FR); Fabrice Hamon, Arrabloy (FR)

(73) Assignee: Otis Elevator Company, Farmington, CT (US)

( * ) Notice: Subject to any disclaimer, the term of this patent is extended or adjusted under 35 U.S.C. 154(b) by 23 days.

(21) Appl. No.: 11/579,077

(22) PCT Filed: May 19, 2004

(86) PCT No.: PCT/IB2004/001711

§ 371 (c)(1),
(2), (4) Date: Oct. 30, 2006

(87) PCT Pub. No.: WO2005/113403

PCT Pub. Date: Dec. 1, 2005

(65) Prior Publication Data

US 2007/0246307 A1 Oct. 25, 2007

(51) Int. Cl.
*B66B 7/06* (2006.01)

(52) U.S. Cl. ..... 187/404; 187/405; 187/414

(58) Field of Classification Search ..... 187/404, 187/405, 414; *B66B 7/06, 17/12*
See application file for complete search history.

(56) References Cited

FOREIGN PATENT DOCUMENTS

| | | |
|---|---|---|
| AT | 389862 B | 2/1990 |
| JP | 61-136888 | 6/1986 |

OTHER PUBLICATIONS

International Preliminary Examination Report for PCT/IB2004/001711, dated Aug. 21, 2006.

*Primary Examiner*—Peter M. Cuomo
*Assistant Examiner*—Stefan Kruer

(57) ABSTRACT

The counterweight according to the invention for an elevator with a frame (1) comprising two vertical U-shaped posts (3) parallel and opposed to each other and connected to each other by at least one upper cross-beam (5) and one lower cross-beam (7), wherein the wings of the vertical posts accommodate flat ballast weights forming a mass and piled up on each other in the frame (1), is characterized in that the upper ballast weights (11'*a*, 11'*b*), at least those located at a higher height than that of the conventional tilted assembly of the lower one-piece ballast weights (11'), comprise at least two parts interlocked with each other so that they can be successively assembled by interlocking them in a plane and in rows between the two posts (3), said interlocking providing a good lateral stiffness to avoid the lateral escape of said two interlocked ballast weight parts (11'*a* and 11'*b*) out of said frame (1) during counterweight displacement.

20 Claims, 4 Drawing Sheets

COUNTERWEIGHT FOR AN ELEVATOR, BALLAST WEIGHTS FOR THIS COUNTERWEIGHT AND ELEVATOR EQUIPPED THEREWITH

BACKGROUND

This invention relates to a counterweight for an elevator, to ballast weights for this counterweight and to an elevator equipped therewith.

Conventional elevator counterweights, as shown by the appended FIGS. 1 to 3, are known to be equipped with a frame 1 comprising two vertical U-shaped posts 3 parallel and opposed to each other and connected to each other by at least one upper cross-beam 5 and one lower cross-beam 7. The wings 9 of the vertical posts, as best seen in FIG. 3, accommodate flat ballast weights 11 forming a mass, piled up on each other in the frame 1. The lower ballast weights are mounted into the frame by inclining them and the upper ballast weights can be inserted horizontally by first inserting an end of the ballast weight into one of the posts 3 and pushing the other end into the other post 3 through a lateral upper cutout 13 provided at the end of that post, then descending the ballast weight between the posts onto the piled-up ballast weights. The ballast weights are assembled up to the top of the frame 1. Finally, the cutout 13 is closed by a stopper (not represented). Such a cutout 13 in one of the posts reduces the strength of the counterweight frame and requires thicker posts, therefore a higher manufacturing cost.

In addition, if no cutout is provided on the post in a counterweight as illustrated by FIG. 2, the ballast weights 11 must be mounted inclined between the posts 3 of the frame. Thus a considerable ballast weight loading space is lost in the upper portion, which can force to lengthen the counterweight frame in order to meet a maximum mass requirement for the counterweight.

In addition, modern elevators without a machine room and with smaller shaft top and bottom spaces require shorter counterweights with the same or even a greater weight.

SUMMARY

This invention aims at solving this problems and provides a counterweight for an elevator with a frame comprising two parallel and opposed vertical posts with a U-shaped cross-section connected to each other by at least one upper cross-beam and one lower cross-beam, wherein the wings of the posts accommodate flat ballast weights forming a mass and piled on top of each other in the frame, characterized in that the upper ballast weights, at least those located at a higher height than that of the conventional tilted assembly of the lower one-piece ballast weights, comprise at least two parts interlocked with each other so that they can be successively assembled by interlocking them in a plane and in rows between the two posts, said interlocking providing a good lateral stiffness to avoid the lateral escape of said two interlocked ballast weight parts out of said frame during counterweight displacement.

As a result of this arrangement, it is no longer necessary to provide a lateral cutout at the end of one of the counterweight frame posts to assemble the ballast weights up to the top of the frame, and the frame posts thus does not have to be reinforced. In addition, assembly is easy, with a lighter weight than with conventional one-piece ballast weights, by laying one of said ballast weight parts accommodated by one post, then laying the other part on the first one and displacing it towards the opposite post until it falls into and interlocks with the first part between the two frame posts, and continuing in the same way for the next rows.

Said two-piece ballast weights interlock at their opposing cut-out ends in a complementary way within some clearance. This terminal cutout can have various shapes, e.g. with a complementary tongue and groove, a dovetail or the like.

Since the posts have no lateral cutout at their upper end like in conventional counterweights, they can have a smaller material thickness for an equivalent strength.

In addition, for the same reason as above, the posts can have a smaller cross-section with the same strength as the conventional cut-out version for the upper assembly of the ballast weights, which allows them to accommodate ballast weights having the same width as conventional ballast weights but cut out at their end with a profile sufficient to cap the sides of the wings of each post and thus provide an additional load at the corners of the ballast weights.

Said terminal cut-out profile of the ballast weights can follow the contour of the inward-looking wings of each post with some clearance, or comprise a U-shaped profile, wherein the legs of the U are bordered by the wings of the posts.

The posts can also be arranged with their wings turned outwards and accommodating ballast weights cut out at their ends to cap the post wings laterally with a U-shaped profile, wherein this arrangement allows providing a cutout further backwards on the ballast weights and thus leaving more available mass.

This invention also deals with counterweight ballast weights comprised of at least two parts interlocking with each other between the posts of the counterweight frame to be mounted at the upper level in a counterweight as defined above.

The invention also relates to counterweight ballast weights cut out at their ends to cap the sides of post wings in a counterweight as defined above.

In all cases, of course, the ballast weights advantageously have a central longitudinal symmetry plane, which is also that of the counterweight.

Lastly, the invention provides an elevator fitted with a counterweight as defined above.

BRIEF DESCRIPTION OF THE DRAWINGS

The invention is illustrated hereafter using an exemplary embodiment and referring to the appended drawings, in which.

DETAILED DESCRIPTION

Figure 1:
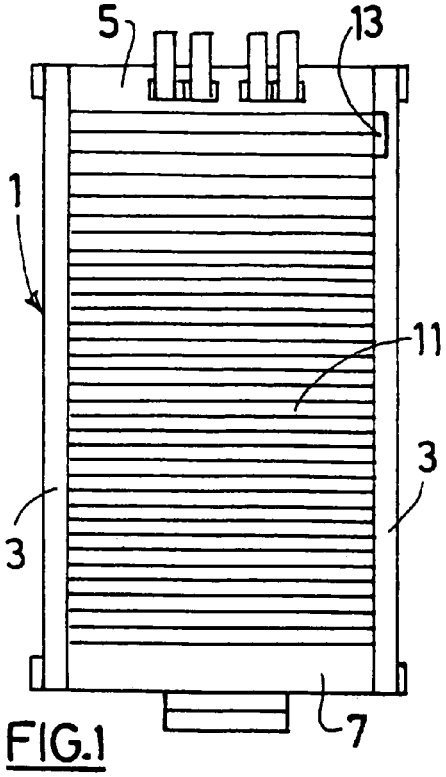
FIG.1 PRIOR ART
FIG. 1 is an elevation view of a conventional counterweight with a lateral cutout at the end of one of its post allowing to assemble ballast weights up to the top of the counterweight frame.
Figure 2:
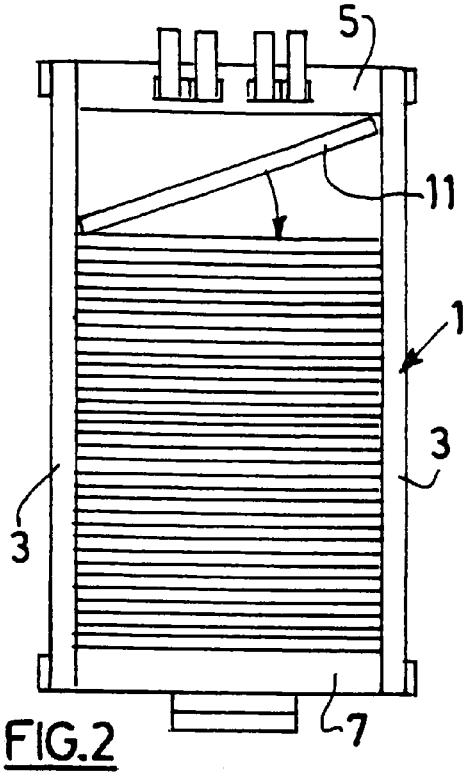
FIG.2 PRIOR ART
FIG. 2 is a similar view of a conventional counterweight without a lateral cutout in one of the posts and with a limited loading height.
Figure 3:
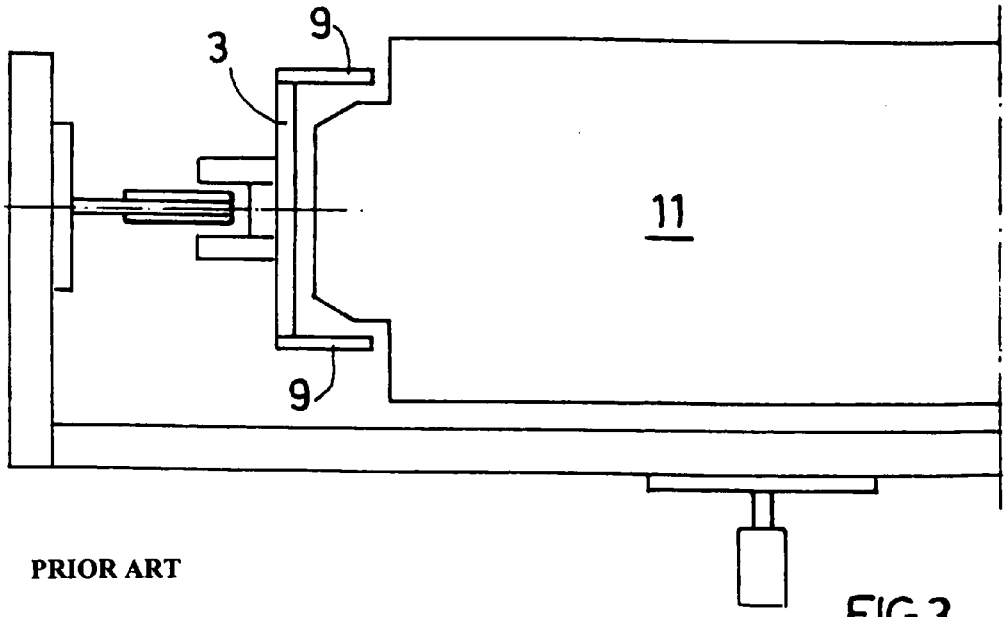
PRIOR ART FIG.3
FIG. 3 is a view of the abovementioned counterweight in a partial cross-section.

The same or similar reference numerals have been used to indicate elements of the invention that are the same as or similar to those mentioned in FIGS. 1 to 3 according to prior art.

Figure 4:
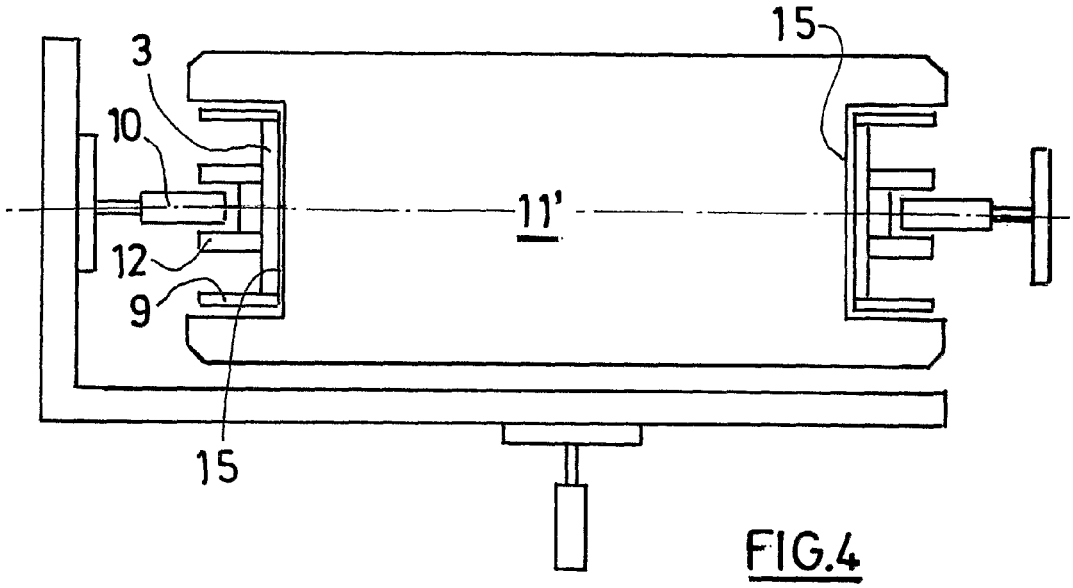
FIGS. 4 and 5 are top cross-sectional views of a counterweight according to the invention at the lower and upper level, respectively.
Figure 5:
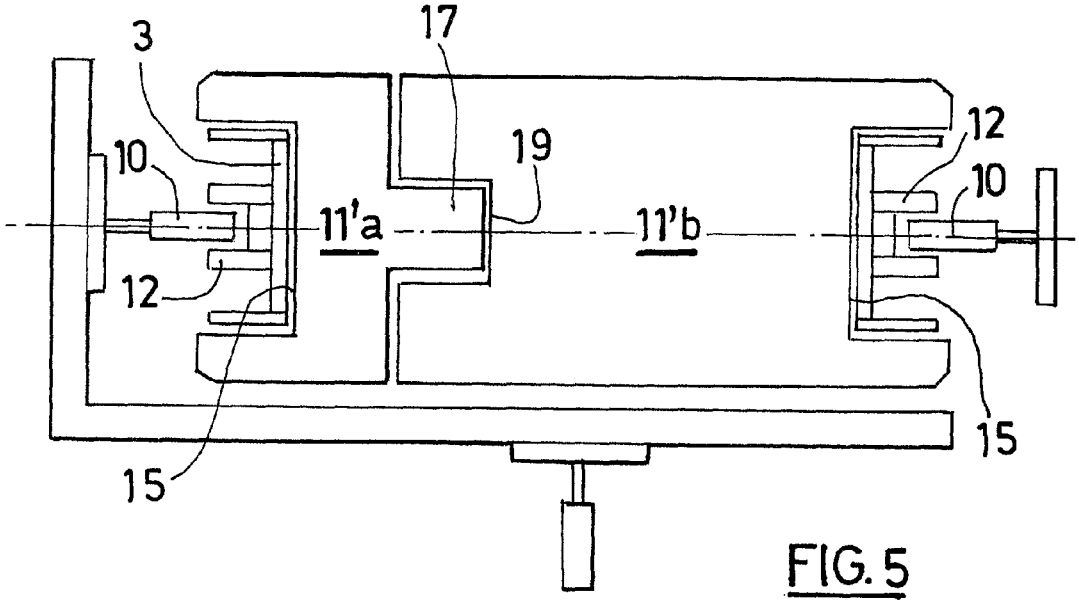
Figure 10:
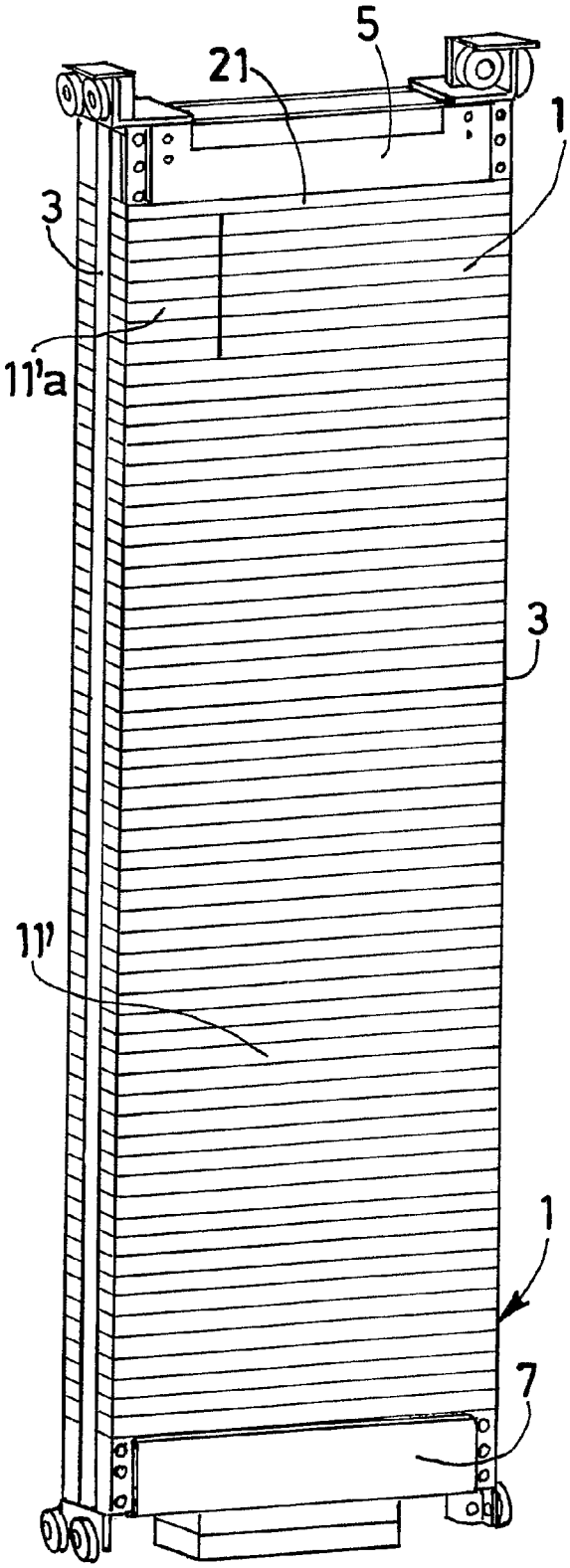
FIG. 10 is a perspective view of a counterweight according to the invention fully loaded with ballast weights.
Figure 6:
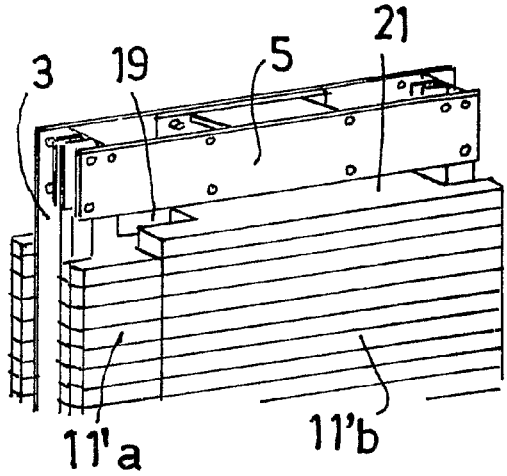
FIGS. 6 to 9 show the successive assembly of the upper two-part ballast weights on this counterweight.
Figure 7:
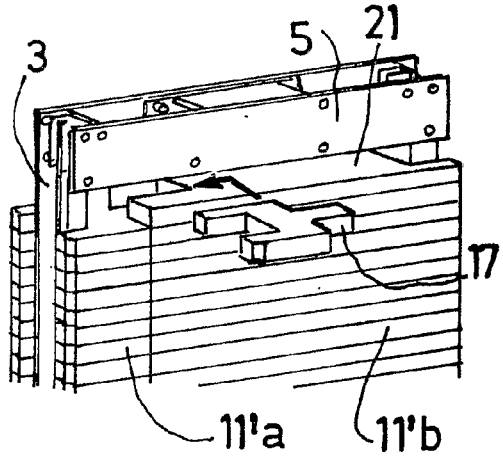
Figure 8:
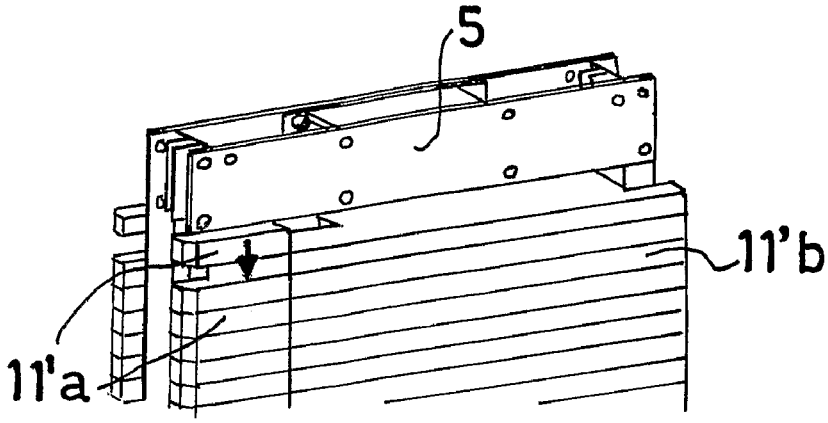
Figure 9:
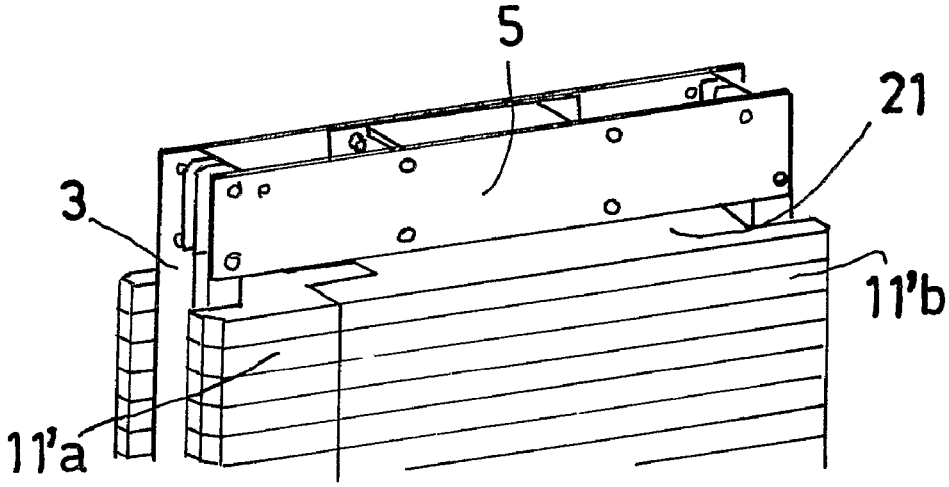

Referring particularly to FIGS. 4, 5, and 10, a counterweight according to the invention is basically made of two parallel vertical posts 3 connected to each other by a lower cross-beam 7 and an upper cross-beam 5. The posts 3, the lower cross-beam 7 and the upper cross-beam 5 form a closed frame 1 inside which flat ballast weights 11' adding to the counterweight mass are piled upon each other. The assembly has a median symmetry plane (median plan of the frame).

This counterweight is mounted to slide vertically in a conventional way in the elevator shaft on guide rails 10 by means of slides 12 attached to the posts.

The posts 3 (FIGS. 4-5) have a regular U-shaped cross-section, with the wings 9 of the U turned outwards. They are mounted opposite each other and accommodate the ballast weights 11 in a vertical pile. These ballast weights are cut out at their ends with a regular U-shaped section 15 complementary to within some clearance of the cross-section of the posts 3 and covering them laterally. They have a median symmetry plane (the same as that of the counterweight).

The lower ballast weights 11' are formed in one piece up to a given height level in the counterweight where they can be mounted inclined into frame 1, as in FIG. 2.

The upper ballast weights (FIG. 5) are divided into two complementary parts 11'*a* and 11'*b* interlocked with each other between the posts 3, with a smaller part 11'*a* on the left and a larger part 11'*b* on the right. They interlock rigidly with a slight clearance at their opposing ends with a tongue 17 and a groove 19 in their central longitudinal part. The length of the tongue 17 is sufficient to maintain the assembly of interlocked parts 11'*a* and 11'*b* aligned during movement and thus hinder their lateral escape out of the posts 3.

The assembly of these ballast weights in several rows, approximately 4 to 5 at the upper level, is described hereafter in reference with FIGS. 6 to 9. More precisely, the assembly of the last upper row is described, the lower rows being assembled in the same way.

The heaviest ballast weight, i.e. the right one 11'*b* (FIG. 6) is first laid and aligned with the underlying ballast weights and against the right post 3, then the smaller ballast weight 11'*a* is laid into the remaining free space 21 in the height of an upper ballast weight over the right one 11'*b* that has already been laid (FIG. 7) and then displaced to the left in the direction of the arrow against the left post 3. It then interlocks vertically into the ballast weight 11'*b* that is already in place (FIG. 8) by falling down in the direction of the arrow and against the left post.

With this construction, for a counterweight height of approximately 3 meters, the additional mass of the counterweight according to the invention as compared to a conventional version is about ten percent (10%) of the counterweight weight for a conventional eight-person elevator, which can be taken advantage of by shortening the length of the counterweight proportionately.

Figure 11:
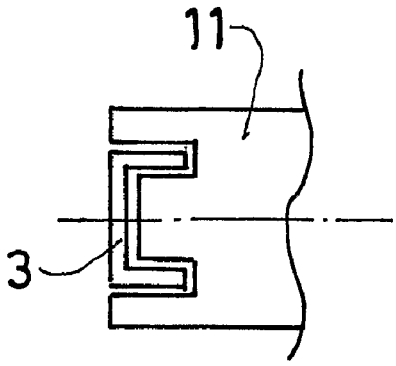
FIG. 11 is a partial sectional view of a variant of the end profile of the ballast weights.

As a variant (FIG. 11), it should be noted that the wings of the posts can be turned inwards and the profile of the end cutout of the ballast weights can follow the cross-sectional contour of the posts within some clearance, and particularly be cut out with a sufficient spacing profile to turn over the outside of the wings, which was not possible heretofore because the cross-section of the posts was too large in conventional counterweights relative to the width of the ballast weights.

The invention claimed is:

1. A counterweight for an elevator, the counterweight comprising:

a plurality of ballast weights; and a frame comprising:

two posts;

an upper cross-beam; and a lower cross-beam;

wherein the posts are connected by the upper and lower cross-beams;

wherein the plurality of ballast weights are configured to be stacked in the frame between the upper and lower cross-beams;

wherein the two posts comprise projecting wings that are configured to engage the ballast weights, wherein at least one of the ballast weights is formed from two separable, interlocking ballast weight parts, and wherein the interlocking ballast weight parts are individually configured to be inserted into the frame and subsequently interlocked within the frame.

2. The counterweight for an elevator according to claim 1, wherein the interlocking engagement of the interlocking ballast weight parts is configured to provide a lateral stiffness that is sufficient to avoid lateral escape of the interlocking ballast weight parts out of the frame during counterweight displacement.

3. The counterweight for an elevator according to claim 1, wherein the wings of the each of the posts defines a recess along an outer side of the respective post.

4. The counterweight for an elevator according to claim 1, wherein each of the posts has a substantially uniform cross-section between the upper and lower beams.

5. The counterweight for an elevator according to claim 1, wherein a first end of each of the interlocking ballast weight parts comprises a recess that is configured to receive a respective one of the posts.

6. The counterweight for an elevator according to claim 1, wherein at least one of the ballast weights is integrally formed, wherein the at least one integrally formed ballast weight comprises a first recess formed in one end thereof and a second recess formed in a second end thereof, and wherein the at least one integrally formed ballast weight is configured to be: (a) inserted into the frame at a an angle relative to the lower cross-beam; (b) rotated such that each of the recesses receives a respective one of the posts; and (c) rest within the frame substantially parallel to the lower cross-beam.

7. The counterweight for an elevator according to claim 3, further comprising:

slides provided in each of the recesses defined by the wings of each of the posts.

8. The counterweight for an elevator according to claim 5, wherein a second end of a first of the interlocking ballast weight parts comprises a projection, wherein a second end of a second of the interlocking ballast weight parts comprises a recess, and wherein the recess of the second end of the second of the interlocking ballast weight parts is configured to receive the projection of the second end of the first of the interlocking ballast weight parts to interlock the two interlocking ballast weight parts.

9. The counterweight for an elevator according to claim 5, wherein a first of the interlocking ballast weight parts is configured to be: (a) inserted into the frame substantially parallel to the lower cross-beam; and (b) positioned such the recess formed in the first end thereof receives a first of the posts.

10. The counterweight for an elevator according to claim 9, wherein a second of the interlocking ballast weight parts is configured to be: (a) inserted into the frame substantially parallel to the lower cross-beam and above the first of the interlocking ballast weight parts; (b) moved laterally within the frame such that the recess formed in the first end thereof receives a second of the posts; and (c) lowered to interlock with the first of the interlocking ballast weight parts.

11. The counterweight for an elevator according to claim 6, wherein a first end of each of the interlocking ballast weight parts comprises a recess that is configured to receive a respective one of the posts.

12. The counterweight for an elevator according to claim 11, wherein a first of the interlocking ballast weight parts is configured to be: (a) inserted into the frame substantially parallel to the lower cross-beam and above the at least one integrally formed ballast weight; and (b) positioned such the recess formed in the first end thereof receives a first of the posts.

13. The counterweight for an elevator according to claim 12, wherein a second of the interlocking ballast weight parts is configured to be: (a) inserted into the frame substantially parallel to the lower cross-beam and above the first of the interlocking ballast weight parts; (b) moved laterally within the frame such that the recess formed in the first end thereof receives a second of the posts; and (c) lowered to interlock with the first of the interlocking ballast weight parts.

14. An elevator comprising:

a car;

a counterweight connected to the car, the counterweight comprising:

a plurality of ballast weights; and a frame comprising:

two posts;

an upper cross-beam; and a lower cross-beam;

wherein the posts are connected by the upper and lower cross-beams;

wherein the plurality of ballast weights are configured to be stacked in the frame between the upper and lower cross-beams;

wherein the two posts comprise projecting wings that are configured to engage the ballast weights, wherein at least one of the ballast weights is formed from two separable, interlocking ballast weight parts, and wherein the interlocking ballast weight parts are individually configured to be inserted into the frame and subsequently interlocked within the frame.

15. The elevator according to claim 14, wherein each of the posts has a substantially uniform cross-section between the upper and lower beams.

16. The elevator according to claim 14, wherein a first end of each of the interlocking ballast weight parts comprises a recess that is configured to receive a respective one of the posts.

17. The elevator according to claim 14, wherein at least one of the ballast weights is integrally formed, wherein the at least one integrally formed ballast weight comprises a first recess formed in one end thereof and a second recess formed in a second end thereof, and wherein the at least one integrally formed ballast weight is configured to be: (a) inserted into the frame at a an angle relative to the lower cross-beam; (b) rotated such that each of the recesses receives a respective one of the posts; and (c) rest within the frame substantially parallel to the lower cross-beam.

18. The elevator according to claim 16, wherein a second end of a first of the interlocking ballast weight parts comprises a projection, wherein a second end of a second of the interlocking ballast weight parts comprises a recess, and wherein the recess of the second end of the second of the interlocking ballast weight parts is configured to receive the projection of the second end of the first of the interlocking ballast weight parts to interlock the two interlocking ballast weight parts.

19. The elevator according to claim 16, wherein a first of the interlocking ballast weight parts is configured to be: (a) inserted into the frame substantially parallel to the lower cross-beam; and (b) positioned such the recess formed in the first end thereof receives a first of the posts, and wherein a second of the interlocking ballast weight parts is configured to be: (a) inserted into the frame substantially parallel to the lower cross-beam and above the first of the interlocking ballast weight parts; (b) moved laterally within the frame such that the recess formed in the first end thereof receives a second of the posts; and (c) lowered to interlock with the first of the interlocking ballast weight parts.

20. The elevator according to claim 17, wherein a first end of each of the interlocking ballast weight parts comprises a recess that is configured to receive a respective one of the posts, wherein a first of the interlocking ballast weight parts is configured to be: (a) inserted into the frame substantially parallel to the lower cross-beam and above the at least one integrally formed ballast weight; and (b) positioned such the recess formed in the first end thereof receives a first of the posts, and wherein a second of the interlocking ballast weight parts is configured to be: (a) inserted into the frame substantially parallel to the lower cross-beam and above the first of the interlocking ballast weight parts; (b) moved laterally within the frame such that the recess formed in the first end thereof receives a second of the posts; and (c) lowered to interlock with the first of the interlocking ballast weight parts.

* * * * *